US006323406B1

(12) United States Patent
Park

(10) Patent No.: US 6,323,406 B1
(45) Date of Patent: Nov. 27, 2001

(54) GUITAR STAND

(76) Inventor: In-Jae Park, 477-7, Tokgye-Ri, Hocchon Eup, Yangju-Gun, Kyonggi Do (KR)

( * ) Notice: Subject to any disclaimer, the term of this patent is extended or adjusted under 35 U.S.C. 154(b) by 0 days.

(21) Appl. No.: 09/543,391

(22) Filed: Apr. 5, 2000

(51) Int. Cl.[7] ..... G10D 3/00
(52) U.S. Cl. ..... 84/327; 84/421; 248/434
(58) Field of Search ..... 84/327, 421; 248/176.1, 248/434, 285.1, 167

(56) References Cited

U.S. PATENT DOCUMENTS 4,037,815 * 7/1977 DeLano ..... 248/542
4,943,021 * 7/1990 Cien et al. ..... 248/167
5,973,244 * 10/1999 McCulloch ..... 84/327

* cited by examiner

*Primary Examiner*—Shih-Yung Hsieh
(74) *Attorney, Agent, or Firm*—R. W. Becker & Associates; R. W. Becker

(57) ABSTRACT

A guitar stand is disclosed. The guitar stand comprises two rest frames, two back support arms, two tilt prevention feet, and two stoppers. The rest frames support a guitar at the bottom portion of the guitar, the rest frames being hinged to each other at their rear ends and respectively having recesses in the rear portions of their lower surfaces. Two back support arms support the guitar at the back portion of the guitar, the back support arms being respectively connected to the rear portions of outer side surfaces of the rest frames to be rotated in a vertical plane directed forward and rearward. The tilt prevention feet prevent the guitar stand from being tilted to the right or left and sustain the back support arms in raised positions, the tilt prevention feet being respectively connected to the rest frames to be rotated in a horizontal plane while being positioned in the recesses of the rest frames. The stoppers restrict excessive rotation of the back support arms rearward, the two stoppers being respectively fixed to the extreme rear portions of the outer side surfaces of the rest frames.

5 Claims, 5 Drawing Sheets

GUITAR STAND

BACKGROUND OF THE INVENTION

1. Field of the Invention

The present invention relates, in general, to guitar stands used to display guitars in places such as shops and, more particularly, to a guitar stand that is light and is easily folded so as to obtain convenience in storing and carrying a guitar, is capable of sustaining the guitar stably so as to bear up against a certain degree of impact, and allows advertisements to appear on its front plate so as to improve its advertisement effect.

2. Description of the Prior Art

Conventional guitar stands serve simply to sustain guitars. Therefore, no provision for convenience in storing and carrying guitars is made in the conventional guitar stands. Additionally, the stands cannot even sustain the guitars stably.

That is, the conventional guitar stands are inconvenient in storing and carrying guitars because of the weights and sizes of the stands, and cannot sustain guitars stably due to the insufficient holding structures of the stands. In addition, the conventional stands do not have a provision for displaying advertisements.

SUMMARY OF THE INVENTION

Accordingly, the present invention has been made keeping in mind the above problems occurring in the prior art, and an object of the present invention is to provide a guitar stand that is light and is easily folded so as to obtain convenience in storing and carrying a guitar.

Another object of the present invention is to provide a guitar stand that is capable of sustaining a guitar stably so as to bear up against a certain degree of impact.

A further object of the present invention is to provide a guitar stand that allows advertisements to appear on its front so as to improve its advertisement effect.

In order to accomplish the above object, the present invention provides a guitar stand, comprising two rest frames for supporting a guitar at the bottom portion of the guitar, the rest frames being hinged to each other at their rear ends and respectively having recesses in the rear portions of their lower surfaces, two back support arms for supporting the guitar at the back portion of the guitar, the back support arms being respectively connected to the rear portions of outer side surfaces of the rest frames to be rotated in a vertical plane directed forward and rearward, two tilt prevention feet for preventing the guitar stand from being tilted to the right or left and sustaining the back support arms in raised positions, the tilt prevention feet being respectively connected to the rest frames to be rotated in a horizontal plane while being positioned in the recesses of the rest frames, and two stoppers for restricting excessive rotation of the back support arms rearward, the two stoppers being respectively fixed to the extreme rear portions of the outer side surfaces of the rest frames.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
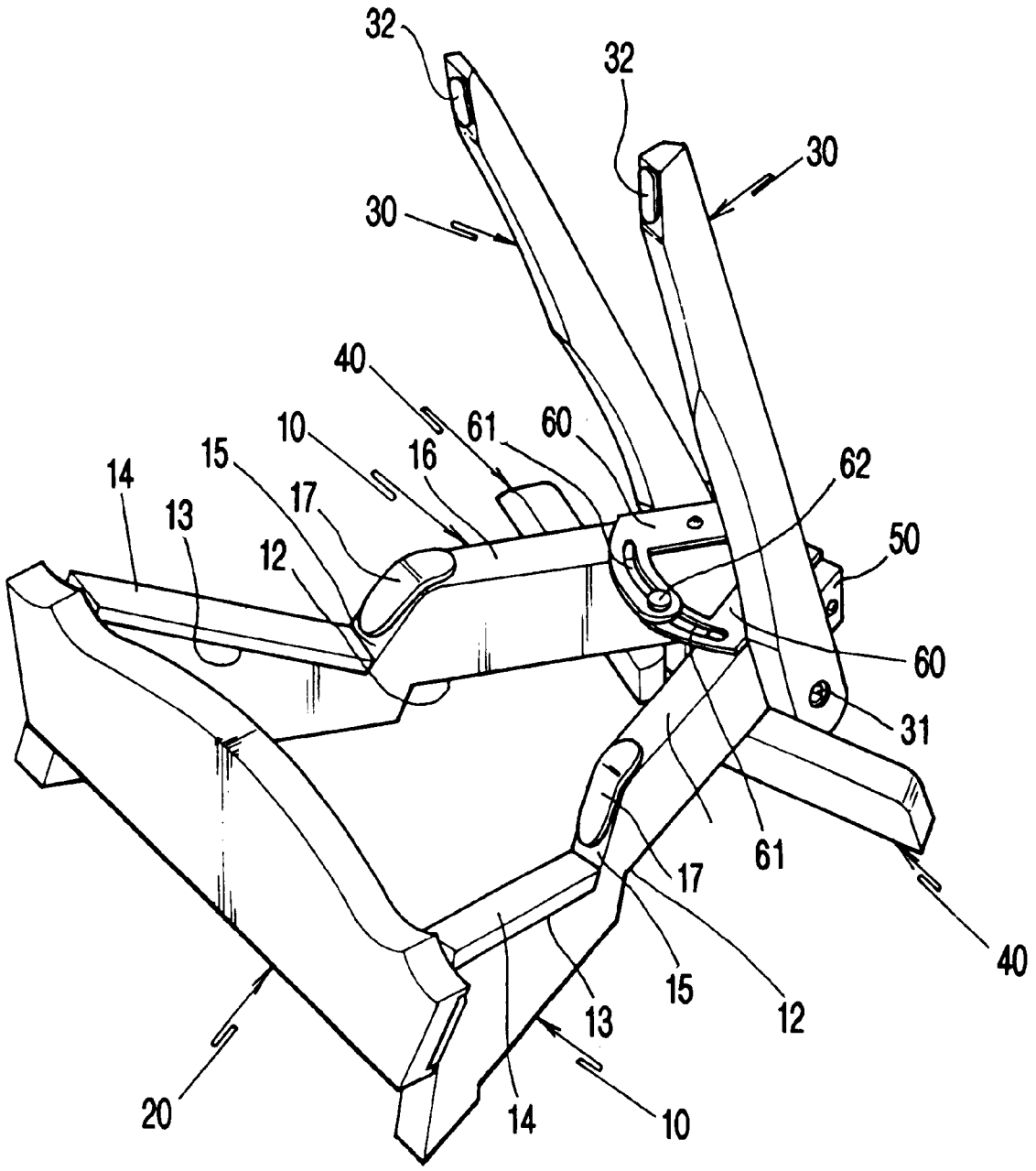
FIG. 1 is a perspective view showing a guitar stand of the present invention in a spread state.
Figure 2:
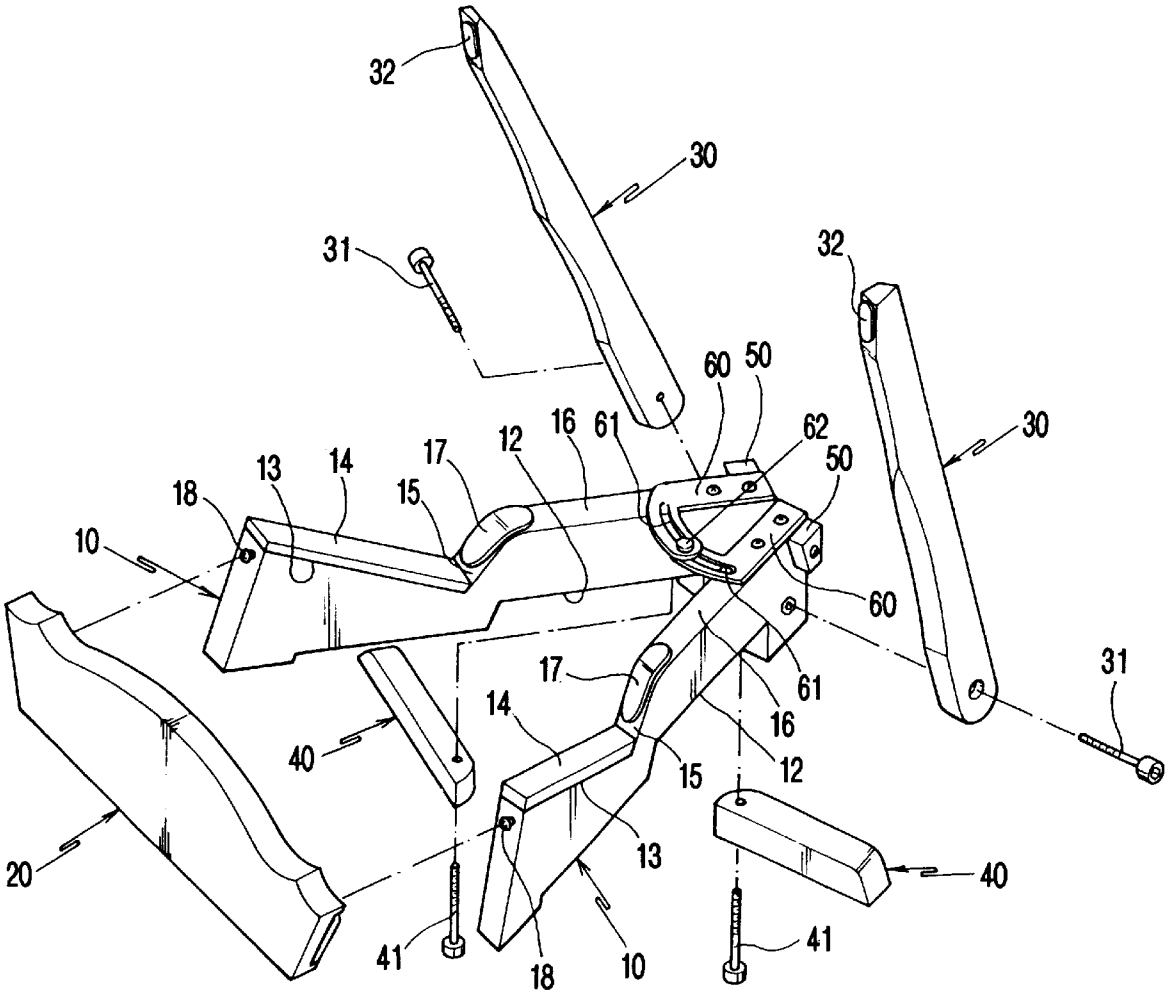
FIG. 2 is an exploded view of FIG. 1.
Figure 3:
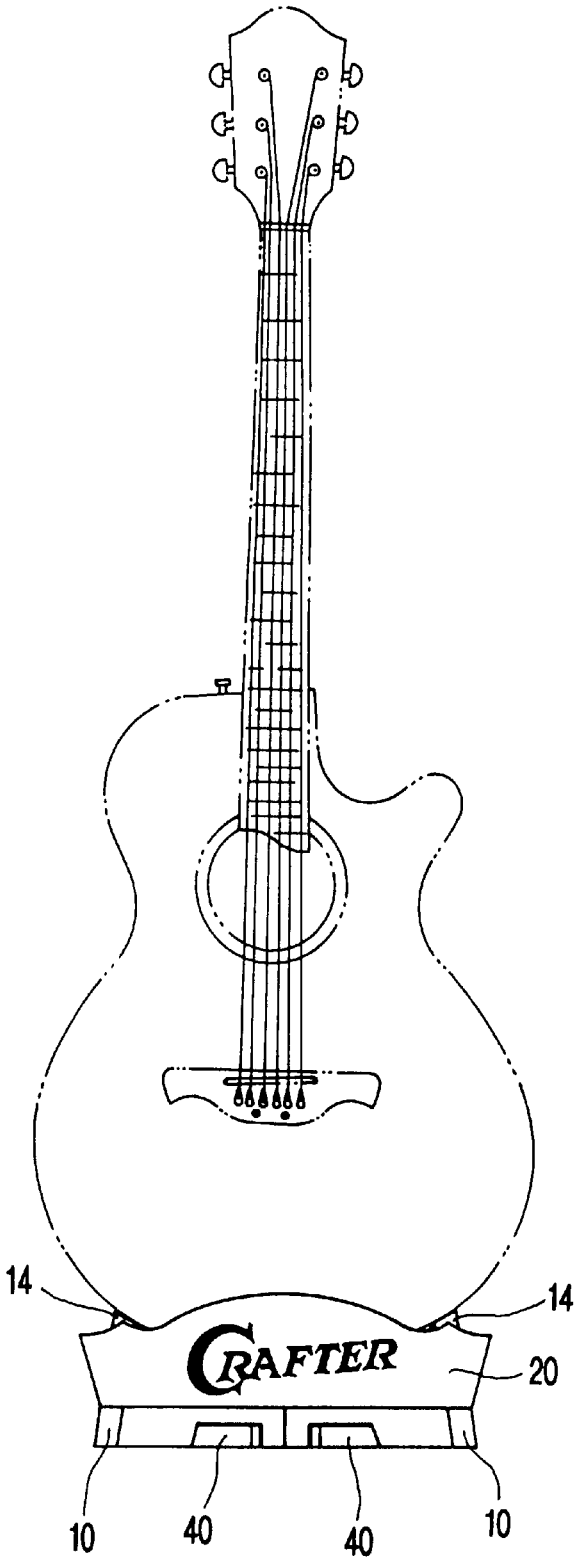
FIG. 3 is a front view showing the guitar stand of the present invention in use.
Figure 4:
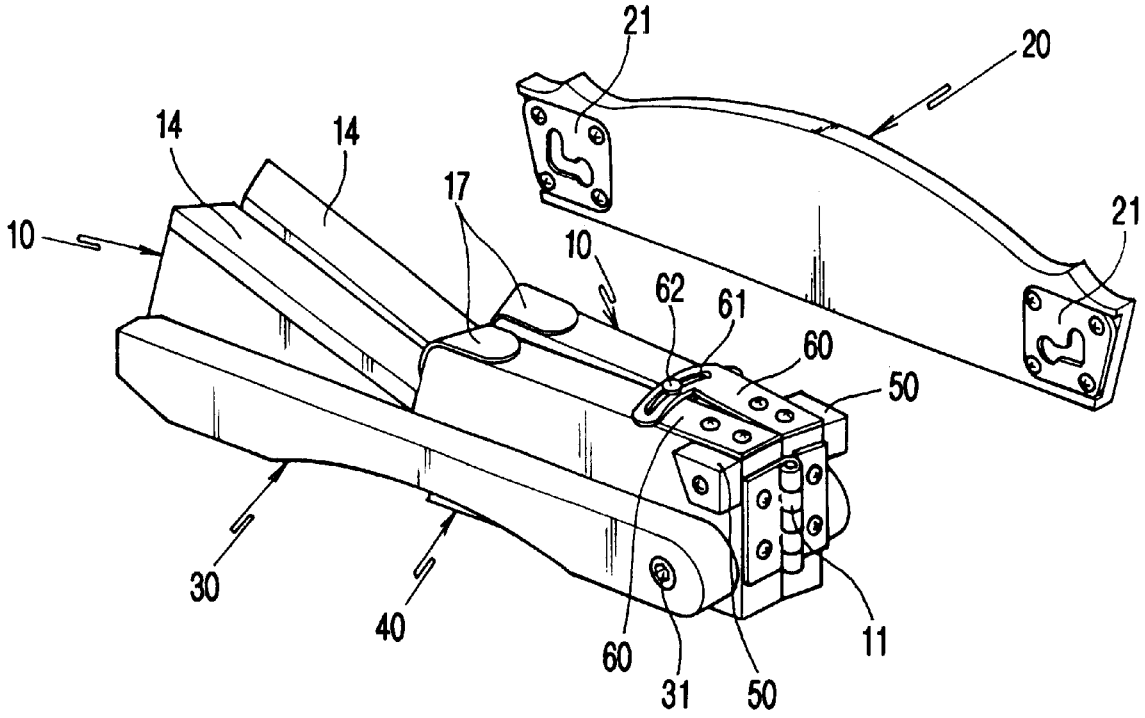
FIG. 4 is a perspective view showing the guitar stand in a folded state.
Figure 5:
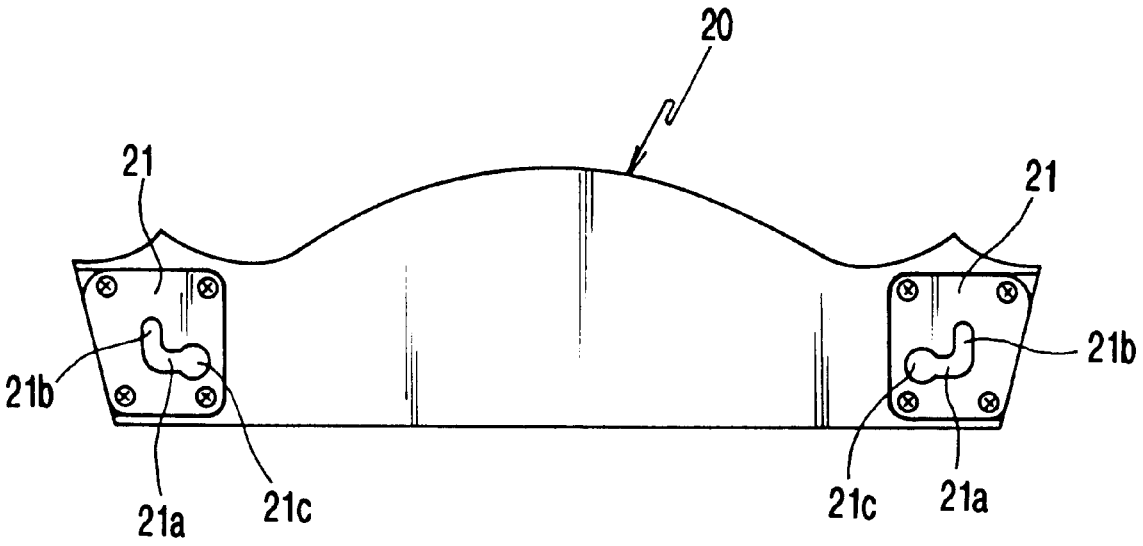
FIG. 5 is a rear view showing a front member of the guitar stand.
Figure 6:
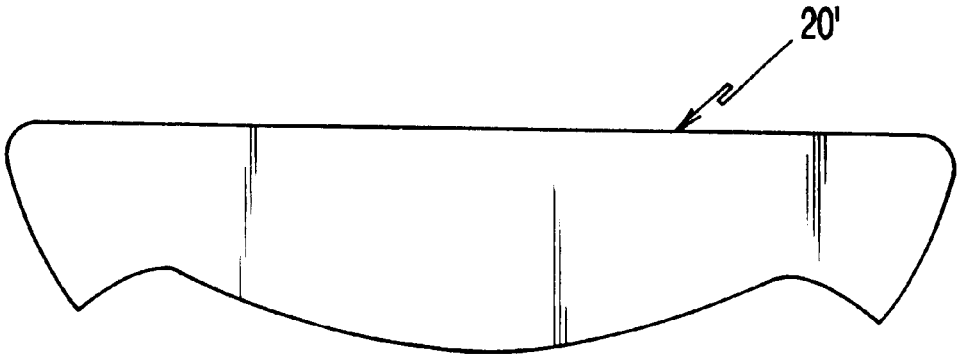
FIG. 6 is a front view showing another front member of the guitar stand.

FIG. 1 is a perspective view showing a guitar stand of the present invention in a spread state. FIG. 2 is an exploded view of FIG. 1. FIG. 3 is a front view showing the guitar stand of the present invention in use. FIG. 4 is a perspective view showing the guitar stand in a folded state. FIG. 5 is a rear view showing a front member of the guitar stand. FIG. 6 is a front view showing another front member of the guitar stand.

As illustrated in the drawings, the guitar stand basically consists of two rest frames 10, a front plate 20, two back support arms 30, two tilt prevention feet 40, and two stoppers 50.

The rest frames 10 serve to support a guitar at the bottom portion of the guitar while preventing the guitar from being scratched while being raised to an inclined position, and are connected to each other at their rear ends by means of a hinge 11 (FIG. 4) so as to selectively be folded and spread. Each of the rest frames 10 is stepped on the front half of its upper surface to have a gradually inclined surface 13 and a steeply inclined surface 15. The intermediate portion between the steeply inclined surface 15 and a horizontal surface 16 of the rear half of the upper surface of the rest frame 10 is rounded off. Two elastic pads 14 and 17 are attached to the gradually inclined surface 13 and the rounded intermediate portion, respectively. The elastic pads 14 and 17 serve to absorb impact applied by the guitar and prevent the guitar from being scratched. Two screws 18 (FIG. 2) are respectively fixed to the front end surfaces of the rest frames 10 with their heads projected from the front end surfaces. Additionally, the rest frames 10 are respectively provided with recesses 12 at the rear halves of their lower surfaces.

The front plate 20 may be detachably combined with the rest frames 10 with the rear surface of the front plate 20 in contact with the front end surfaces of the rest frames 10. The front plate 20 serves to define the interval between the two spread rest frames 10, to prevent the guitar from being removed forwardly and to allow advertisements to appear on its front surface. For the purpose of improving decorative effect, the contour of the front plate 20 may be designed in various manners. That is, the contour of the front plate 20 may be designed as illustrated in FIGS. 1 to 3 or in FIG. 6 (in this case, the front plate is designated by reference numeral 20'). Two metal plates 21 (FIG. 4) are provided on both side end portions of the rear surface of the front plate 20, with two fitting slots being respectively formed on the metal plates 21. Each of the fitting slots comprises a horizontal slot 21*a*, a vertical slot 21*b* connected to the horizontal slot 21*a*, and an insertion hole 21*c* being formed on the closed end of the horizontal slot 21*a* and having a sufficient size for receiving the head of the screw 18. The front plate 20 is combined with the rest frames 10 in such a way that the heads of the screws 18 are respectively inserted into the insertion holes 21*c*, the screws 18 are moved along the horizontal and vertical slots 21*a* and 21*b*, and, finally, the screws 18 are stopped at the upper ends of the vertical slots 21*b*.

Two back support arms 30 are respectively connected to the rear portions of the outer side surfaces of the rest frames 10 to be rotated in a vertical plane directed forward and rearward by means of pins 31. The front upper surfaces of the back support arms 30 are cut diagonally when viewed in a state where the back support arms 30 are erected. Two elastic pads 32 are attached to the diagonally cut front upper surfaces so as to absorb impact applied by the guitar and prevent the guitar from being scratched, respectively. The back support arms 30 serve to support the guitar at the rear portion of the guitar while preventing the guitar from being scratched while being raised to an inclined position.

The tilt prevention feet 40 are respectively connected to the upper surfaces of the recesses 12 to be rotated in a horizontal plane by means of pins 41 (FIG. 2). The tilt prevention feet 40 serve to prevent the guitar stand from being tilted to the right or left and to sustain the back support arms 30 in raised positions.

The stoppers 50 are respectively fixed to the extreme rear portions Of the outer side surfaces of the rest frames 1 0. The stoppers 50 serve to restrict the excessive rotation of the back support arms 30 to the rear.

In addition, an interval defining member 60 is provided on the rear portions of the upper surfaces of the rest frames 10. The interval defining member 60 consists of two boomerang-shaped pieces respectively provided with arcuate slots 61 and a sliding pin 62 slidably inserted into the arcuate slots 61. The interval defining member is mounted to the rest frames 10 while the boomerang-shaped pieces are overlapped. The interval defining member 60 serves to define the interval between the spread rest frames 10. When the rest frames 10 are fully spread, the sliding pin 62 is positioned at the interior ends of the arcuate slots 61, thereby defining the interval between the spread rest frames 10.

The parts of the guitar stand may be preferably made of light wood or synthetic resin so as to facilitate the carriage of the parts and reduce the manufacturing cost of the parts.

The operation of the guitar stand of the present invention is as follows.

First of all, the two rest frames 10, that exist in a folded state as shown in FIG. 4, are spread. In this case, the interval between the spread rest frames 10 is defined by the action of the interval defining member 60.

Subsequently, the front plate 20 may be detachably combined with the rest frames 10 with the rear surface of the front plate 20 in contact with the front end surfaces of the rest frames 10, in such a way that the heads of the screws 18 are respectively inserted into the insertion holes 21*c*, the screws 18 are moved along the horizontal and vertical slots 21*a* and 21*b*, and the screws 18 are stopped at the upper ends of the vertical slots 21*b*. At this time, the front plate 20 is combined with the rest frames 10, while the rest frames 10 are spread.

Thereafter, the two back support arms 30 are raised rearward. In this case, the stopper 50 prevents the back support arms 30 from being raised excessively.

Next, the two tilt prevention feet 40 are respectively rotated to the right and left, thereby preventing the back support arms from being bowed again and the guitar stand from being tilted to the right or left.

At this time, the bottom of the guitar is rested on the rest frames 10 and the back of the guitar is supported by the support arms 30, so that the guitar is supported by means of the guitar stand while it is leaned back.

Referring to FIG. 3, when advertisements are displayed on the front surface of the front plate 20, its advertising effect is improved, thereby attracting consumers' attention to the guitar.

When the guitar stand is not used to rest the guitar, it is folded in accordance with an opposite procedure to the above-described procedure for spreading the guitar stand. As shown in FIG. 4, in a folded state, the guitar stand is easily stored and carried.

Incidentally, it should be understood that the guitar stand of the present invention is not only used for resting a guitar, but may also be used for resting similar musical instruments, such as a mandolin.

As described above, the present invention provides a guitar stand that is light and is easily folded so as to obtain convenience in storing and carrying a guitar, is capable of sustaining the guitar stably so as to bear up against a certain degree of impact, and allows advertisements to appear on its front plate so as to improve its advertisement effect.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A guitar stand, comprising:

two rest frames for supporting a guitar at a bottom portion of the guitar, said rest frames being hinged to each other at their rear ends and respectively having recesses in rear portions of their lower surfaces;

two back support arms for supporting the guitar at a back portion of the guitar, said back support arms being respectively connected to rear portions of outer side surfaces of said rest frames to be rotated in a vertical plane directed forward and rearward;

two tilt prevention feet for preventing the guitar stand from being tilted to the right or left and sustaining the back support arms in raised positions, said tilt prevention feet being respectively connected to said rest frames to be rotated in a horizontal plane while being positioned in the recesses of said rest frames; and two stoppers for restricting excessive rotation of said back support arms rearward, said two stoppers being respectively fixed to extreme rear portions of the outer side surfaces of said rest frames.

2. The stand according to claim 1, wherein each of said rest frames is stepped on a front portion of its upper surface to have a gradually inclined surface and a steeply inclined surface, wherein an intermediate portion between the steeply inclined surface and a horizontal surface of a rear portion of the upper surface of said rest frame is rounded off, and wherein two elastic pads are respectively attached to the gradually inclined surface and the rounded intermediate portion.

3. The stand according to claim 1, further comprising a front plate for defining an interval between said rest frames, preventing the guitar from departing from said rest frames forwardly and allowing advertisements to appear on its front surface, the front plate being detachably combined with the rest frames with a rear surface of said front plate in contact with front end surfaces of the rest frames.

4. The stand according to claim 3, wherein said front plate is detachably combined with the rest frames by engaging two screws with two metal plates, said metal plates being provided on both side portions of a rear surface of said front plate with two fitting slots being respectively formed on the metal plates, each of the fitting slots consisting of a horizontal slot, a vertical slot connected to the horizontal slot, and an insertion hole formed on a closed end portion of said horizontal slot, said screws being respectively fixed to the front end surfaces of the rest frames with their heads projecting from the front end surfaces.

5. The stand according to claim 1, further comprising an interval defining member for defining an interval between said spread rest frames, the interval defining member consisting of two boomerang-shaped pieces respectively provided with arcuate slots and a sliding pin slidably inserted into said arcuate slots, said interval defining member being provided on rear portions of said upper surfaces of said rest frames while said boomerang-shaped pieces are overlapped.

* * * * *